US010312623B2

(12) United States Patent
Kim et al.

(10) Patent No.: US 10,312,623 B2
(45) **Date of Patent: *Jun. 4, 2019**

(54) SPRING-LOADED CONTACTS

(71) Applicant: Apple Inc., Cupertino, CA (US)

(72) Inventors: Min Chul Kim, Santa Clara, CA (US); John C. DiFonzo, Emerald Hills, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/722,379

(22) Filed: Oct. 2, 2017

(65) Prior Publication Data

US 2018/0090867 A1 Mar. 29, 2018

Related U.S. Application Data

(63) Continuation of application No. 14/503,307, filed on Sep. 30, 2014, now Pat. No. 9,780,475, which is a (Continued)

(51) Int. Cl.

| | |
|---|---|
| ***H01R 13/24*** | (2006.01) |
| ***H01R 13/62*** | (2006.01) |
| ***H01R 13/17*** | (2006.01) |

(52) U.S. Cl.

CPC ..... *H01R 13/2471* (2013.01); *H01R 13/17* (2013.01); *H01R 13/2421* (2013.01); *H01R 13/62* (2013.01)

(58) Field of Classification Search

CPC H01R 11/18; H01R 13/2421; H01R 13/2428; H01R 13/6315

(Continued)

(56) References Cited

U.S. PATENT DOCUMENTS

| | | | |
|---|---|---|---|
| 2,644,145 | A | 6/1953 | Adams |
| 3,378,810 | A | 4/1968 | Dorrell |

(Continued)

FOREIGN PATENT DOCUMENTS

| | | |
|---|---|---|
| CN | 2682638 | 3/2005 |
| FR | 2 758 395 | 7/1998 |

(Continued)

OTHER PUBLICATIONS

Notice of Allowance dated Nov. 7, 2017 in U.S. Appl. No. 15/226,780, 8 pages.

(Continued)

*Primary Examiner* — Hien D Vu

(74) *Attorney, Agent, or Firm* — Kilpatrick Townsend & Stockton, LLP

(57) ABSTRACT

Spring-loaded contacts having an improved reliability. One example may provide spring-loaded contacts having a reduced likelihood of entanglement between a spring and a plunger. For example, a piston may be placed between a plunger and a spring. The piston may have a head portion that is wider than the diameter of the spring and located between the spring and the plunger to isolate the spring and the plunger. In these and other examples, an additional object, such as a sphere, may be placed between the plunger and spring. In another example, two additional objects, such as two spheres, may be placed between a plunger and piston.

19 Claims, 15 Drawing Sheets

Related U.S. Application Data continuation of application No. 13/492,905, filed on Jun. 10, 2012, now Pat. No. 8,905,795, which is a continuation-in-part of application No. 13/272,200, filed on Oct. 12, 2011, now Pat. No. 8,734,189.

(58) Field of Classification Search
USPC ..... 439/700, 824, 482
See application file for complete search history.

(56) References Cited

U.S. PATENT DOCUMENTS

| | | | | |
|---|---|---|---|---|
| 3,435,168 | A | 3/1969 | Cooney | |
| 4,397,519 | A | 8/1983 | Cooney | |
| 4,597,622 | A | 7/1986 | Coe | |
| 4,612,703 | A | 9/1986 | Cooney | |
| 4,686,465 | A * | 8/1987 | Kruger | G01R 1/07371 324/756.03 |
| 4,874,316 | A | 10/1989 | Kamon et al. | |
| 4,983,909 | A * | 1/1991 | Swart | G01R 1/06722 200/61.76 |
| 5,417,595 | A | 5/1995 | Cullen et al. | |
| 5,801,544 | A | 9/1998 | Swart et al. | |
| 5,993,269 | A | 11/1999 | Ito | |
| 6,053,777 | A | 4/2000 | Boyle | |
| 6,159,056 | A | 12/2000 | Boyle | |
| 6,377,059 | B2 | 4/2002 | Vinther et al. | |
| 6,447,328 | B1 | 9/2002 | Feldman | |
| 6,506,082 | B1 | 1/2003 | Meek et al. | |
| 6,604,864 | B2 | 8/2003 | Nguyen | |
| 6,696,850 | B1 | 2/2004 | Sanders | |
| 6,861,862 | B1 | 3/2005 | Tate | |
| 6,957,986 | B2 | 10/2005 | Jing | |
| 7,315,176 | B2 | 1/2008 | Nelson et al. | |
| 7,611,389 | B2 | 11/2009 | Toivanen et al. | |
| 7,682,206 | B2 | 3/2010 | Kainz | |
| 7,749,032 | B1 | 7/2010 | Yin | |
| 7,798,867 | B2 | 9/2010 | Sanders | |
| 8,043,103 | B2 | 10/2011 | Yamada | |
| 8,337,256 | B1 | 12/2012 | Lin et al. | |
| 8,734,189 | B2 | 5/2014 | Kim | |
| 8,926,376 | B2 | 1/2015 | Mori | |
| 9,130,317 | B2 | 9/2015 | Wang | |
| 9,748,680 | B1 | 8/2017 | Huang et al. | |
| 2003/0124895 | A1 | 7/2003 | Winter et al. | |
| 2003/0176113 | A1 | 9/2003 | Sasaki | |
| 2004/0137800 | A1 | 7/2004 | Jing | |
| 2011/0018567 | A1 | 1/2011 | Shiga | |
| 2013/0095690 | A1 | 4/2013 | Kim et al. | |
| 2013/0330983 | A1 | 12/2013 | DiFonzo et al. | |
| 2016/0020542 | A1 | 1/2016 | Difonzo et al. | |

FOREIGN PATENT DOCUMENTS

| | | |
|---|---|---|
| JP | S50-8785 | 3/1975 |
| JP | S62-76668 | 5/1987 |
| JP | S63-23655 | 2/1988 |
| JP | S63-274070 | 11/1988 |
| JP | H09-072932 | 3/1997 |
| JP | H10-40990 | 2/1998 |
| JP | 10-282142 | 10/1998 |
| JP | 10-332767 | 12/1998 |
| JP | 2001-021583 | 1/2001 |
| JP | 2002-174642 | 6/2002 |
| JP | 2003281984 | 10/2003 |
| JP | 2004-179066 | 6/2004 |
| JP | 2005-005146 | 1/2005 |
| JP | 2006-501475 | 1/2006 |
| JP | 2007-316023 | 12/2007 |
| JP | 2011-027549 | 2/2011 |
| JP | 2011-192407 | 9/2011 |
| JP | 2013-68593 | 4/2013 |
| KR | 20-0255378 | 12/2001 |
| TW | 200301592 | 7/2003 |
| TW | 563929 | 11/2003 |
| TW | M312806 | 5/2007 |
| TW | I286409 | 9/2007 |
| TW | 200803072 A | 1/2008 |
| TW | 2008030724 | 1/2008 |
| TW | I289376 | 11/2008 |
| TW | M406183 | 6/2011 |
| WO | 98/04018 | 1/1998 |
| WO | 2005/053106 | 6/2005 |
| WO | 2013/035399 | 3/2013 |

OTHER PUBLICATIONS

Office Action (English Translation) dated May 3, 2018 in Chinese Patent Application No. 201611051895.7, 13 pages.
Notice of Allowance dated Mar. 26, 2018 in U.S. Appl. No. 15/226,780, 9 pages.
Final Office Action (English Translation) dated Apr. 2, 2018 in Japanese Patent Application No. 2016-094144, 10 pages.
Korean Office Action dated Apr. 15, 2015 for KR Patent Application No. 10-2014-7012587, with English translation, 13 pages.
International Search Report and Written Opinion dated Nov. 28, 2012, for PCT Patent Application No. PCT/US2012/059246, 9 pages.
International Search Report and Written Opinion dated Aug. 7, 2013, for PCT Patent Application No. PCT/US2013/044991, 12 pages.
Non-Final Office Action dated Jul. 19, 2013 for U.S. Appl. No. 13/272,200, 7 pages.
Notice of Allowance dated Jan. 15, 2014 for U.S. Appl. No. 13/272,200, 11 pages.
Non-Final Office Action dated Feb. 24, 2014 for U.S. Appl. No. 13/492,905, 6 pages.
Taiwanese Office Action dated Jun. 10, 2014, for TW Patent Application No. 101137808, with English Translation, 14 pages.
Notice of Allowance dated Aug. 1, 2014 for U.S. Appl. No. 13/913,494, 7 pages.
Chinese Office Action dated Jul. 24, 2014 for CN Patent Application No. 201210385775.6, 15 pages.
Australian Office Action dated Aug. 5, 2014 for AU Patent Application No. 2012323384, 4 pages.
Notice of Allowance dated Sep. 17, 2014 for U.S. Appl. No. 13/492,905, 10 pages.
Japanese Office Action dated Feb. 20, 2015 for JP Patent Application No. 2014-535770, English summary of Office Action included, 10 pages.
European Office Action dated Oct. 14, 2015 for EP Application No. 12779238.0, 5 pages.
Chinese Office Action dated Nov. 5, 2015 for CN Patent Application No. 201210385775.6, 7 pages.
Non-Final Office Action dated Dec. 23, 2015 for U.S. Appl. No. 14/740,029, 5 pages.
Japanese Office Action dated Jan. 7, 2016 for JP Patent Application No. 2014-535770, 7 pages.
Korean Notice of Allowance dated Jan. 21, 2016 for KR Patent Application No. 10-2014-7012587, with English translation, 3 pages.
Taiwanese Office Action dated Feb. 25, 2016, for TW Patent Application No. 10113190, 10 pages.
Taiwanese Search Report dated Feb. 25, 2016, for TW Patent Application No. 10113190, 1 page.
Chinese Office Action dated Mar. 17, 2015 for CN Patent Application No. 201210385775.6, with English translation, 23 pages.
Notice of Allowance dated Mar. 13, 2015 for U.S. Appl. No. 13/913,494, 8 pages.
Notice of Allowance dated Nov. 20, 2014 for U.S. Appl. No. 13/913,494, 8 pages.
Notice of Allowance, U.S. Appl. No. 14/740,029, dated May 3, 2016, 7 pages.
Office Action, Chinese Patent Application No. 201210385775.6, dated May 6, 2016, 18 pages.
Notice of Allowance, Japan Patent Application No. 2014-535770, dated Jun. 10, 2016, 3 pages.

(56) References Cited

OTHER PUBLICATIONS

Office Action, Taiwan Patent Application No. 102113190, dated Mar. 2, 2016, 11 pages.
Office Action (English Translation) dated Apr. 11, 2019 in Chinese Patent Application No. 201611051895.7, 4 pages.

* cited by examiner

SPRING-LOADED CONTACTS

CROSS-REFERENCES TO RELATED APPLICATIONS

This application is a continuation of U.S. patent application Ser. No. 14/503,307, filed Sep. 30, 2014, which is a continuation of U.S. patent application Ser. No. 13/492,905, filed Jun. 10, 2012, which is a continuation-in-part of U.S. patent application Ser. No. 13/272,200, filed Oct. 12, 2011, which are incorporated by reference.

BACKGROUND

The number and types of electronic devices available to consumers have increased tremendously the past few years, and this increase shows no signs of abating. Devices such as portable computing devices, tablet, desktop, and all-in-one computers, cell, smart, and media phones, storage devices, portable media players, navigation systems, monitors and other devices have become ubiquitous.

These devices often receive power and share data using various cables. These cables may have connector inserts, or plugs, on each end. The connector inserts may plug into connector receptacles on electronic devices, thereby forming one or more conductive paths for signals and power.

These inserts or plugs may have contacts that mate with corresponding contacts in a receptacle. These mated contacts may form portions of electrical paths for data, power, or other types of signals. Various types of contacts may be used. One type of contact, a spring-loaded contact, may be used in either a connector insert or a connector receptacle.

Spring-loaded contacts may include a plunger biased by a spring, such that the plunger may be depressed when contacting a second contact, then retracted when disengaged from the second connector. But this arrangement may lead to a reduced reliability for the spring-loaded contact. For example, the spring and plunger may become entangled. That is, the spring may become caught between a plunger and a barrel or housing of the spring-loaded contact. This may prevent the plunger from retracting, thus keeping the plunger depressed.

Also, when a plunger makes contact with a second contact and is depressed, the plunger may break contact with the barrel or housing. This may lead to large current flow through the spring, which may in turn damage or destroy the spring.

Thus, what is needed are spring-loaded contacts that provide an improved reliability by having a reduced tendency for entanglement between a spring and a plunger, and a reduced chance of large currents flowing through the spring.

SUMMARY

Accordingly, embodiments of the present invention may provide spring-loaded contacts having an improved reliability. An illustrative embodiment of the present invention may provide spring-loaded contacts having a reduced likelihood of entanglement between a spring and a plunger. Another illustrative embodiment may have a reduced likelihood of spring damage caused by excess current flow.

Again, in conventional spring-loaded contacts, on occasion a spring or other compliance mechanism may become entangled with a plunger. Specifically, the spring may become caught between the plunger and a housing or barrel of the spring-loaded contact. This may lead to the plunger not retracting or emerging from a face of a connector when the connector is disconnected. Instead, the plunger may remain depressed inside the connector. This may result in either, or both, a cosmetic or functional failure.

Accordingly, an illustrative embodiment of the present invention may provide a spring-loaded contact having an isolation object placed between a plunger and a spring. In a specific example, a piston may be placed between a plunger and a spring. The piston may have a first head portion that is wider than the diameter of the spring, and the head portion may be located between the spring and the plunger. This may isolate the spring and the plunger such that the spring does not become entangled with the plunger. For example, the head portion may help prevent the spring from becoming caught between the plunger and a barrel of the spring-loaded contact. The piston may have a second body portion that is narrower and located in the spring. This may help keep the piston in position such that the head portion remains between the plunger and the spring during use. This piston may be made of various conductive materials, such as stainless steel, brass, gold-plated brass, or other material. In other embodiments, the piston may be formed using nonconductive materials, such as ceramics, plastics, or other materials.

In other embodiments of the present invention, other isolation objects, such as one or more spheres, cylinders, or other objects having other shapes, may be used. These objects may be conductive, and formed of stainless steel, brass, gold-plated brass, or other material. In other embodiments, they may be nonconductive, and formed using ceramics, plastics, or other materials. The plunger and barrel may be brass or other copper based material, such as bronze. The plunger and barrel may further be plated, for example with gold.

Again, in conventional spring-loaded contacts, the plunger may be depressed in a manner that the plunger loses contact with the barrel of the spring-loaded contact. This may result in power supply or other large currents flowing through a relatively narrow spring. The result may be that the spring overheats and breaks or is otherwise damaged.

Accordingly, an illustrative embodiment of the present invention may provide an asymmetric interface between a plunger and an isolation object. For example, an embodiment of the present invention may provide a spring-loaded contact having a plunger with an asymmetric back, for example, an eccentrically-tapered back. For example, the back may be eccentrically-conically shaped. This eccentrically-tapered back may contact the head portion of the piston. The eccentricity may help to ensure that the plunger tilts at an angle such that the plunger or the piston, or both, make contact with the barrel, thereby avoiding potential damage to the spring. The spring itself may be formed conductive or nonconductive material, including stainless steel, such as stainless steel 304, or other appropriate material. For example, music wire or high-tensile steel may be used. The spring may be plated with gold, silver, or other material. The spring may also be coated with a dielectric, such as parylene, to further prevent current flow through the spring. In other embodiments of the present invention, a surface of an isolation object may be asymmetric.

In another illustrative embodiment of the present invention, an additional object may be placed between a plunger and isolation object. This additional object may be conductive and may provide an electrically conductive path between the plunger and a barrel, though the additional object may instead be nonconductive.

In a specific embodiment of the present invention, the additional object may have a spherical or ball shape. The ball may reside between a plunger and an isolation object. The ball may be conductive or nonconductive. A conductive ball may form an electrical path between the plunger and the barrel. In a specific embodiment of the present invention, two additional objects may be employed. These additional objects may both have a spherical shape, and they may both reside between a plunger and an isolation object. Either or both of these additional objects may be conductive or nonconductive.

In various embodiments of the present invention, the additional object may be employed with various isolation objects. For example, the isolation object may be a plunger as described above. In other embodiments, the isolation object may be a second ball, that is, it may have a sphere shape. In various embodiments of the present invention, the additional object and the isolation object may be of similar or different sizes. The isolation object may be conductive or nonconductive.

Various embodiments of the present invention may also employ various structures, coatings, or other techniques, either alone or in combination, to improve the reliability of spring-loaded contacts. For example, contaminants, such as liquids, may be drawn inside a housing a spring-loaded contact. This liquid may be drawn into the housing by vacuum and suction forces created when the plunger is depressed and released. Accordingly, an embodiment of the present invention may reduce these forces by adding a vent or other opening in the spring-loaded contact housing. By reducing the vacuum and suction forces created when the plunger is depressed and released, liquids and other contaminants are not drawn, or are drawn to a lesser extent, into the housing, and long-term reliability may be improved. The vent may be formed using drilling, laser etching, or other appropriate technique. Also, in various embodiments of the present invention, some or all of the housing, plunger, spring, isolation object, additional object, and other components, may be coated with one or more layers to provide protection against such contaminants, even when they are reduced through the use of a vent. Hydrophobic or oleophobic layers may be used to protect against contaminants. For example, parylene or other coatings may be used.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
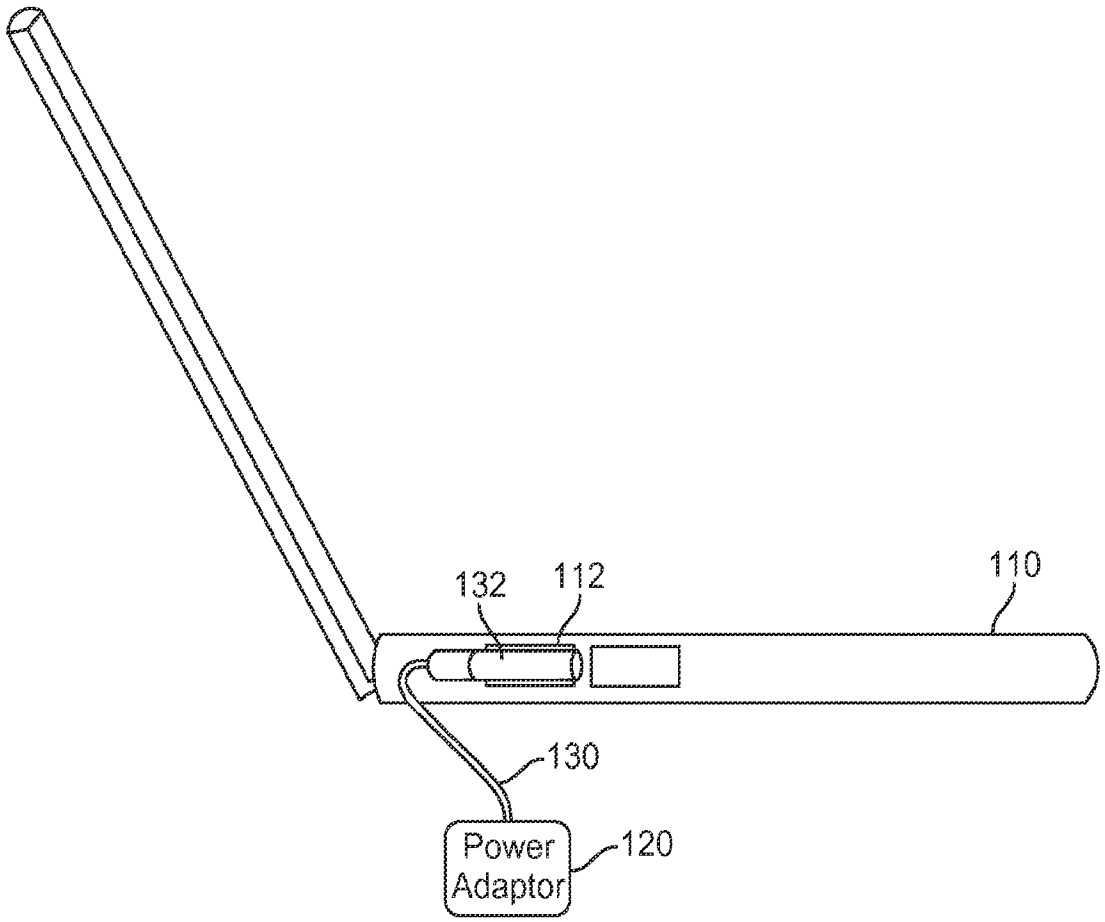
FIG. 1 illustrates a magnetic connector system according to an embodiment of the present invention.

FIG. 1 illustrates an electronic system that may be improved by the incorporation of embodiments of the present invention. This figure, as with the other included figures, is shown for illustrative purposes and does not limit either the possible embodiments of the present invention or the claims.

This figure includes electronic device 110. In this specific example, electronic device 110 may be a laptop computer. In other embodiments of the present invention, electronic device 110 may be a netbook or tablet computer, cell, media, or smart phone, global positioning device, media player, or other such device.

Electronic device 110 may include a battery. The battery may provide power to electronic circuits in electronic device 110. This battery may be charged using power adapter 120. Specifically, power adapter 120 may receive power from an external source, such as a wall outlet or car charger. Power adapter 120 may convert received external power, which may be AC or DC power, to DC power, and it may provide the converted DC power over cable 130 to plug 132. In other embodiments of the present invention, plug, or insert 132 may be coupled through cable 130 to another type of device. Plug 132 may be arranged to mate with receptacle 112 on electronic device 110. Power may be received at receptacle 112 from plug 132 and provided to the battery and electronic circuitry in electronic device 110. In other embodiments of the present invention, data or other types of signals may also be provided to electronic device 110 via plug or insert 132.

Figure 2:
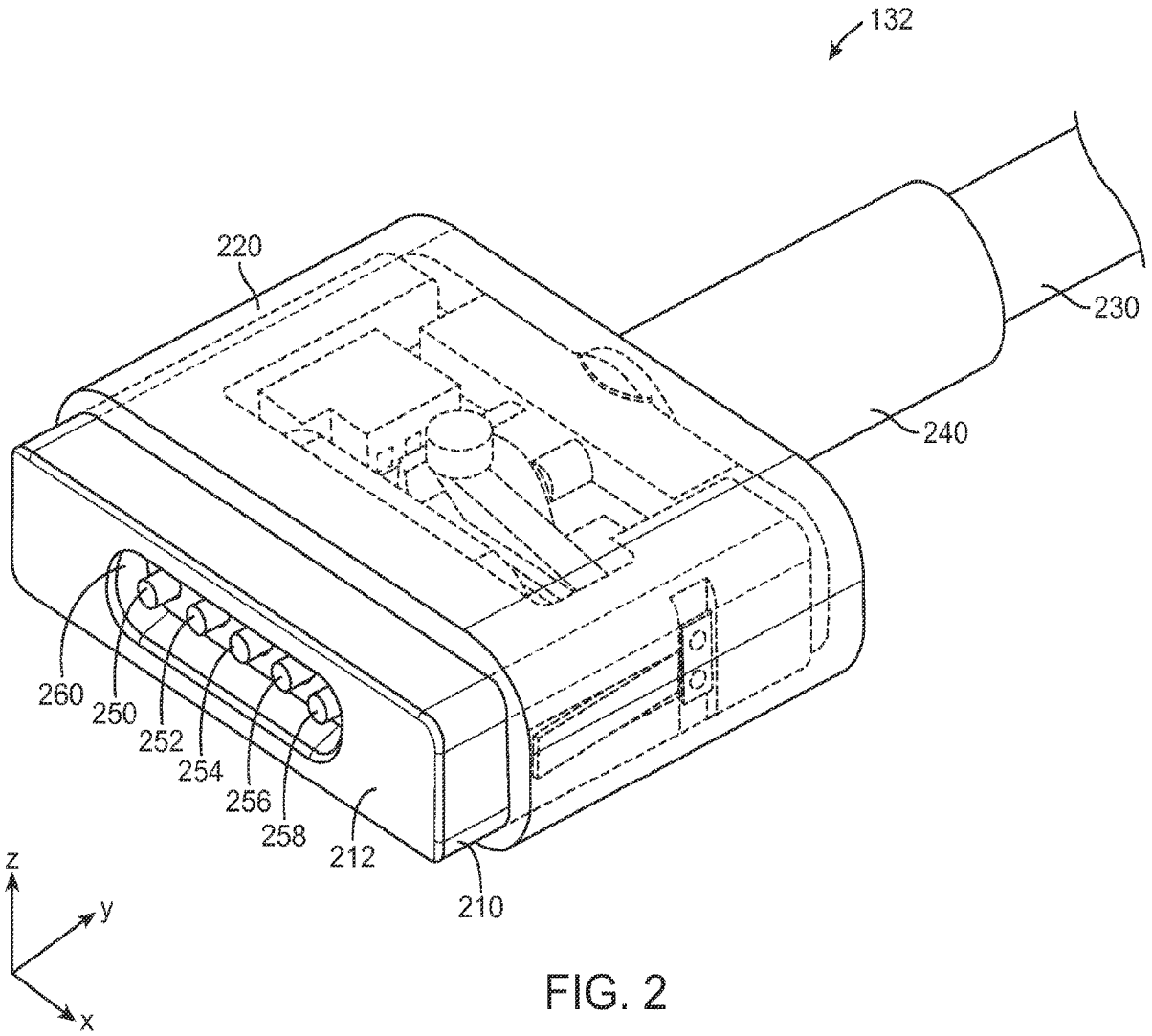
FIG. 2 illustrates a connector insert according to an embodiment of the present invention.

FIG. 2 illustrates a connector insert 132 according to an embodiment of the present invention. Connector insert 132 may include an attraction plate 210, shield or cover 220, cable 230, and strain relief 240. Attraction plate 210 may include front surface 212. Front surface 212 may include opening 260 for contacts 250, 252, 254, 256, and 258. In a specific embodiment of the present invention, contacts 250 and 258 may convey ground, contacts 252 and 256 may convey power, while contact 254 may be used to detect that a connection has been formed. In this specific example, contacts 250 and 258 protrude in front of the other contacts, such that ground paths are formed before power is applied when connector insert 132 is mated with a corresponding connector receptacle.

In various embodiments of the present invention, contacts 250, 252, 254, 256, and 258 may be spring-loaded contacts. Examples of spring-loaded contacts according to embodiments of the present invention are shown in the following figures.

Figure 3:
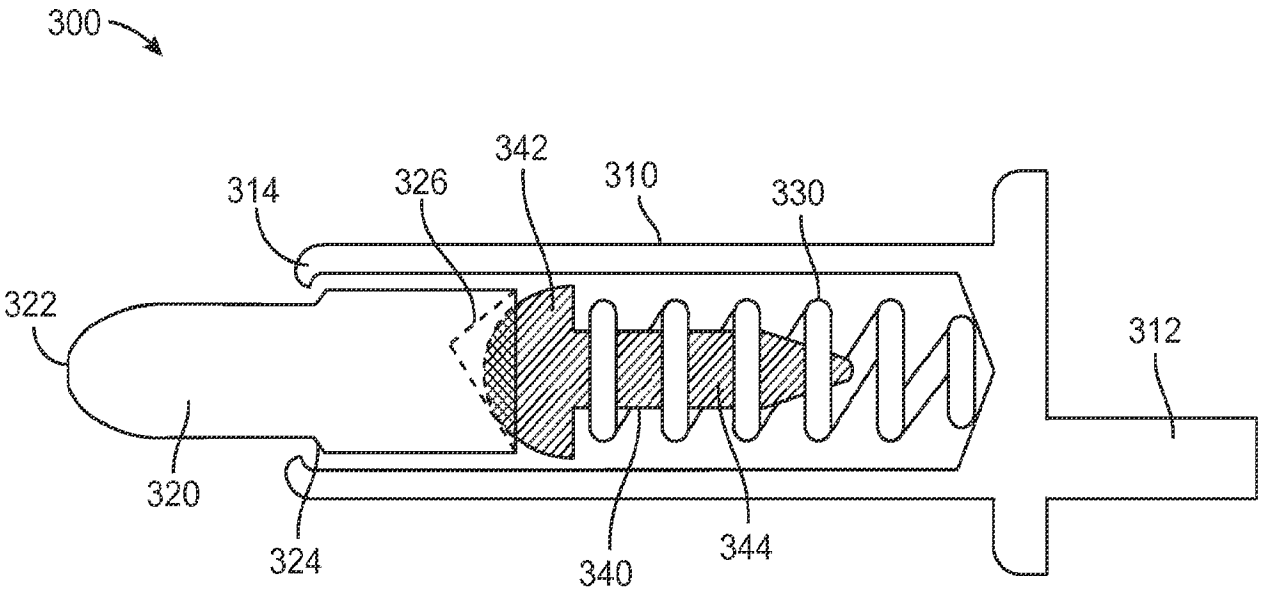
FIG. 3 illustrates a spring-loaded contact according to an embodiment of the present invention.

FIG. 3 illustrates a spring-loaded contact according to an embodiment of the present invention. Spring-loaded contact 300 may be used as contacts 250, 252, 254, 256, or 258, in FIG. 2. Spring-loaded contact 300 may be housed in a housing or barrel 310. Barrel 310 may include tail 312. Tail 312 may be soldered to a printed circuit board or other structure in a connector, such as connector insert 132 in FIG. 2.

Spring-loaded contact 300 may further include plunger 320. Plunger 320 may have tip 322 to mate with a second contact in another connector. Plunger 320 may further include notch or wider portion 324. Notch 324 may contact portion 314 of housing 310, thereby limiting the retraction of plunger 320.

Spring-loaded contact 300 may further include a compliance mechanism, such as spring 330. Spring 330 may extend to retract plunger 320 from barrel 310 when a connector that houses spring-loaded contact 300 is disengaged from a corresponding connector. Spring 330 may compress, thereby allowing plunger 320 to be depressed into housing or barrel 310 when the connector that houses spring-loaded contact 300 is engaged with the corresponding connector.

Again, in conventional spring-loaded contacts, a spring may become entangled with a plunger during use. For example, a spring may become caught between a plunger and a barrel or housing. This may prevent the plunger from retracting fully from the housing. This, in turn, may lead to either or both cosmetic and functional failures.

Accordingly, embodiments of the present invention may employ an isolation object between plunger 320 and spring 330. In this specific example, the isolation object comprises piston 340. Piston 340 may include a head 342 and a body 344. Head 342 may be wider than a diameter of spring 330. Head 342 may be located between plunger 320 and spring 330. Body 344 may be narrower than an inside diameter of spring 330, it and may be substantially inside spring 330.

While the isolation object is shown here as piston 340, in other embodiments of the present invention, other isolations object may be used. For example, a sphere may be used as an isolation object. In still other embodiments of the present invention, other isolation objects may be used. For example, a cylinder-shaped, or other shaped object may be used. These isolation objects may prevent spring 330 from getting caught between barrel 310 and plunger 320.

Again, as a plunger is depressed, it may lose contact with a barrel or housing of the spring-loaded contact. Under these circumstances, current may flow through the spring. While this condition may be reasonable when the spring-loaded contact is conveying a signal, it may be damaging when a power supply or ground return is conveyed. This current flow may damage or destroy the spring. Specifically, resistance in the spring may lead to its being heated by the current flow. This heating may cause the spring to lose its elasticity. Such damage may again cause cosmetic or functional failures.

Accordingly, embodiments of the present invention may provide an asymmetry in an interface between a plunger and an isolation object, such that when the plunger is depressed, the plunger or isolation object, or both, maintain contact with the barrel such that the spring is protected from large currents. In this specific example, piston 340 contacts plunger 320 at a back surface 326. Back surface 326 may be asymmetric such that when plunger 320 is depressed, plunger 320 or piston 340, or both, are tilted relative to a center line through spring-loaded contact 300 and maintain contact with barrel 310. In this specific example, back surface 326 has an eccentrically-tapered hole. For example, back surface 326 may be eccentrically-conically shaped. In other embodiments of the present invention, back surface 326 may have other shapes. In other embodiments the present invention, the asymmetry may be located on a leading surface of piston 340 or other isolation object.

The asymmetry at this interface may force either or both the plunger and the piston into a side of the barrel. This force may help to reduce the low-level contact resistance of spring-loaded contact 300. An example is shown in the following figure.

Figure 4:
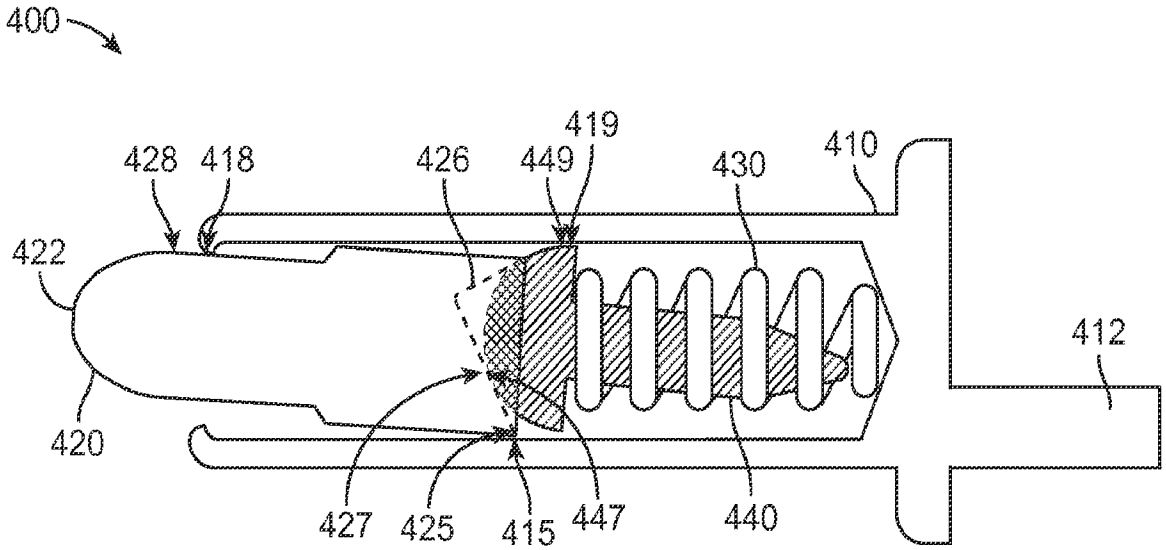
FIG. 4 illustrates the spring-loaded contact of FIG. 3 where a plunger has been depressed.

FIG. 4 illustrates the spring-loaded contact of FIG. 4 where a plunger has been depressed. Specifically, plunger 420 is shown as being depressed relative to housing 410. In this figure, spring 430 is compressed and piston 440 is pushed further back into housing 410. The asymmetric surface 426 of plunger 420 acts to tilt plunger 420 and piston 440. Specifically, point 428 of plunger 420 may contact housing or barrel 410 at point 418. Similarly, point 425 of plunger 420 may contact housing or barrel 410 at point 415.

In this example, piston 440 may tilt such that it contacts both back surface 426 of plunger 420 and housing or barrel 410. Specifically, point 447 of piston 440 may contact plunger 420 and point 427. Also, point 449 of piston 440 may contact barrel 410 at point 419.

This may provide several electrical paths from tip 422 of plunger 420 to tail 412 of housing 410. Specifically, current may flow from tip 422 to point 428 of plunger 420 to point 418 of housing 410, then to tail 412. Current may also flow from tip 422 to point 425 on plunger 420, then to point 415 on barrel 410, then to tail 412. Current may also flow from tip 422 to point 427 on plunger 420 to point 447 on piston 440, then to point 449 on piston 440 to point 419 on barrel 410, then to tail 412. Depending on the exact geometries and relative position of these components, some or all of these or other electrical paths may be formed as plunger 420 is depressed relative to barrel 410.

Figure 5:
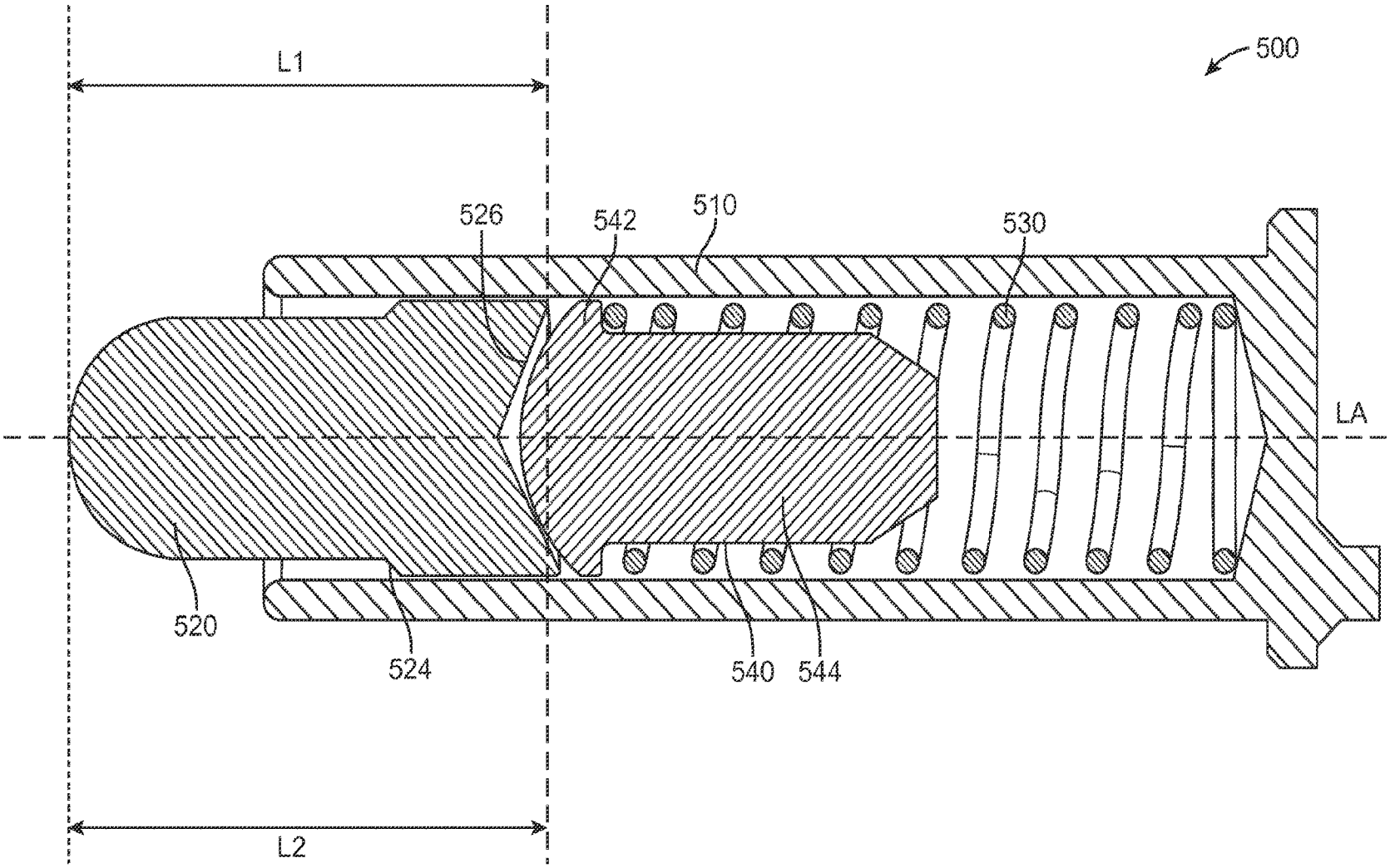
FIG. 5 illustrates a cutaway view of a spring-loaded contact according to an embodiment of the present invention.

FIG. 5 illustrates a cutaway view of a spring-loaded contact according to an embodiment of the present invention. Spring-loaded contact 500 may be the same as spring-loaded contact 300, or it may be a different spring-loaded contact. Spring-loaded contact 500 includes barrel or housing 510. Plunger 520 may be at least partially enclosed in housing 510. Plunger 520 may have notch 524, which may be used as a stop to limit the retraction of plunger 520. Plunger 520 may have an asymmetric back 526. Again, in this example, isolation object 540 is shown as a piston having a head portion 542 and a body portion 544. Head portion 542 may be wider than a diameter of spring 530. Body portion 544 may be narrower than inside diameter of spring 530, and it may be substantially surrounded by spring 530. Spring 530 may compress and expand, allowing movement of plunger 520. As before, plunger 520 may electrically contact barrel or housing 510.

In this example, a back surface 526 of plunger 520 is asymmetric. However, even with this asymmetry, a longitudinal length of plunger 520 is approximately the same along all parts of its surface. For example, length L1 may be approximately the same as length L2 for each L1 and L2. This is because back surface 526 of plunger 520 may have an outer rim that is at least substantially orthogonal to the longitudinal axis LA of plunger 520. The result is when plunger 520 is depressed in barrel 510, when the tip of plunger 520 is moved in various directions, plunger 520 may tilt approximately the same amount in each direction. This may assist the spring-loaded contacts to make connections with fixed contacts in a second connector.

Again, while in this example, a back 526 of plunger 520 is shown as having an asymmetric surface, in other embodiments of the present invention, a leading edge of piston 540 or other isolation object may have an asymmetric surface.

Figure 6:
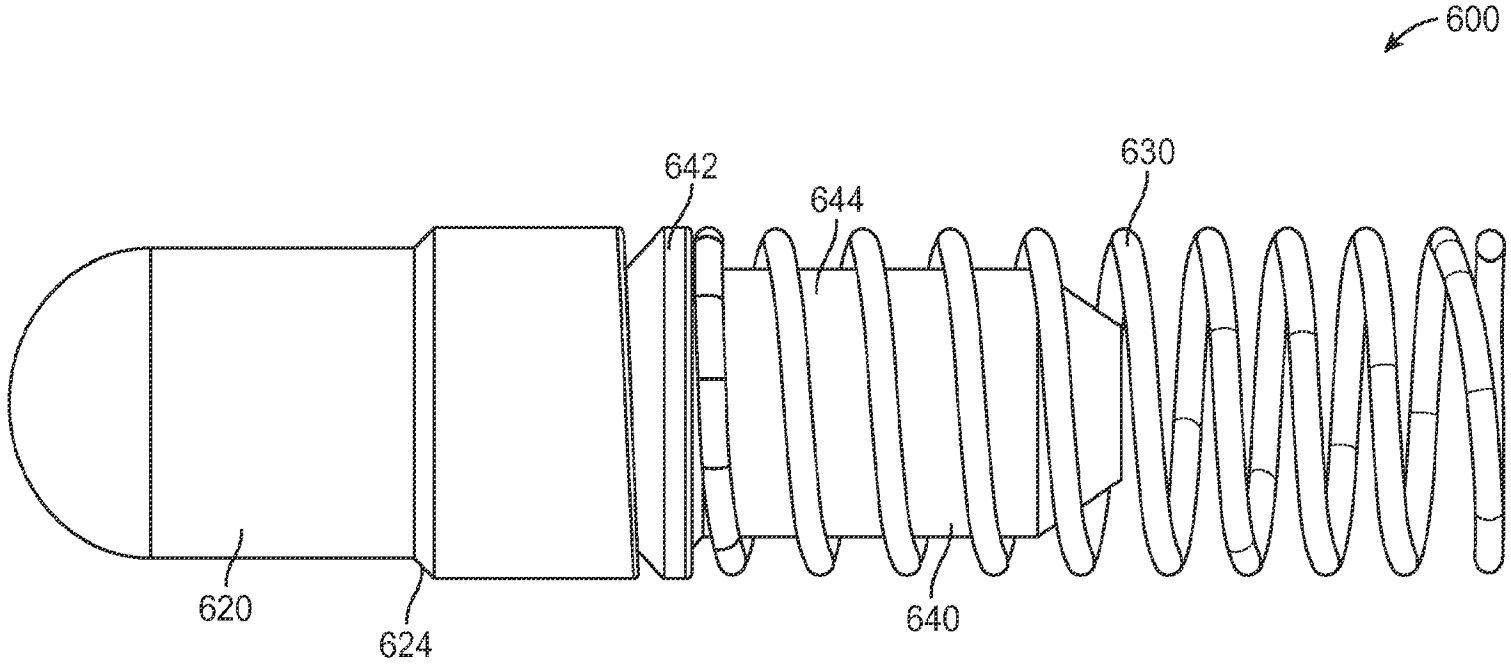
FIG. 6 illustrates a portion of a spring-loaded contact according to an embodiment of the present invention.

FIG. 6 illustrates a portion of a spring-loaded contact according to an embodiment of the present invention. Portion 600 may be a portion of spring-loaded contacts 300 or 500, or other spring-loaded contact according to embodiments of the present invention. This figure includes plunger 620, which has notch 624, piston 640, comprising a head 642 and body 644, and spring 630.

Figure 7:
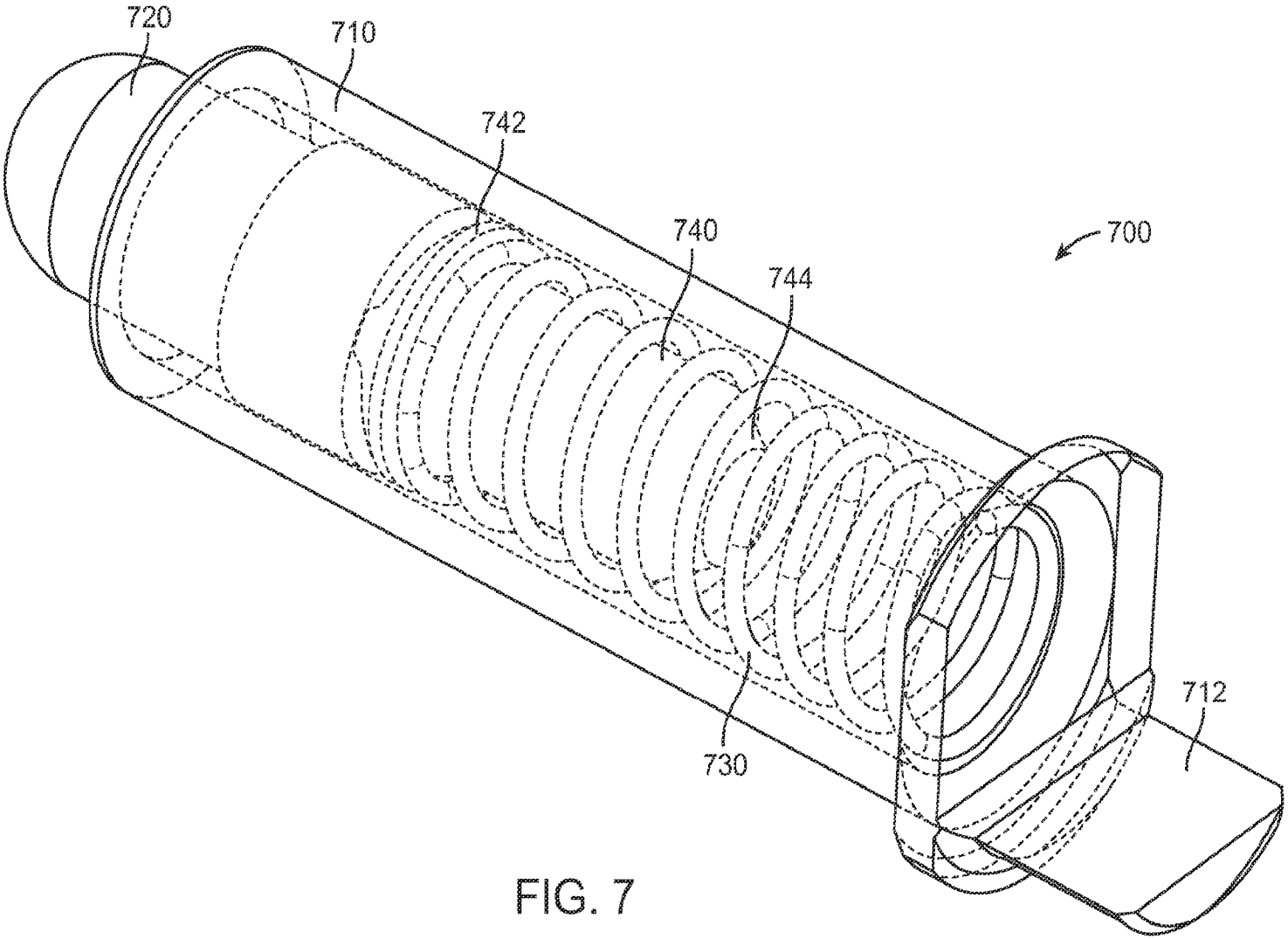
FIG. 7 illustrates an oblique view of a spring-loaded contact according to an embodiment of the present invention.

FIG. 7 illustrates an oblique view of a spring-loaded contact according to an embodiment of the present invention. The spring-loaded contact 700 may be the same as the other spring-loaded contacts shown herein, or it may be a different spring-loaded contact. Spring-loaded contact 700 may include a housing or barrel 710, plunger 720, spring 730, and isolation object 740. Housing 710 may include tail 712 to connect to a printed circuit board or other structure in a connector, such as connector insert 132 in FIG. 2. Isolation object 740 is shown as a piston having a head 742 and body 744.

Again, in other embodiments of the present invention, other isolation objects may be used. One example is shown in the following figure.

Figure 8:
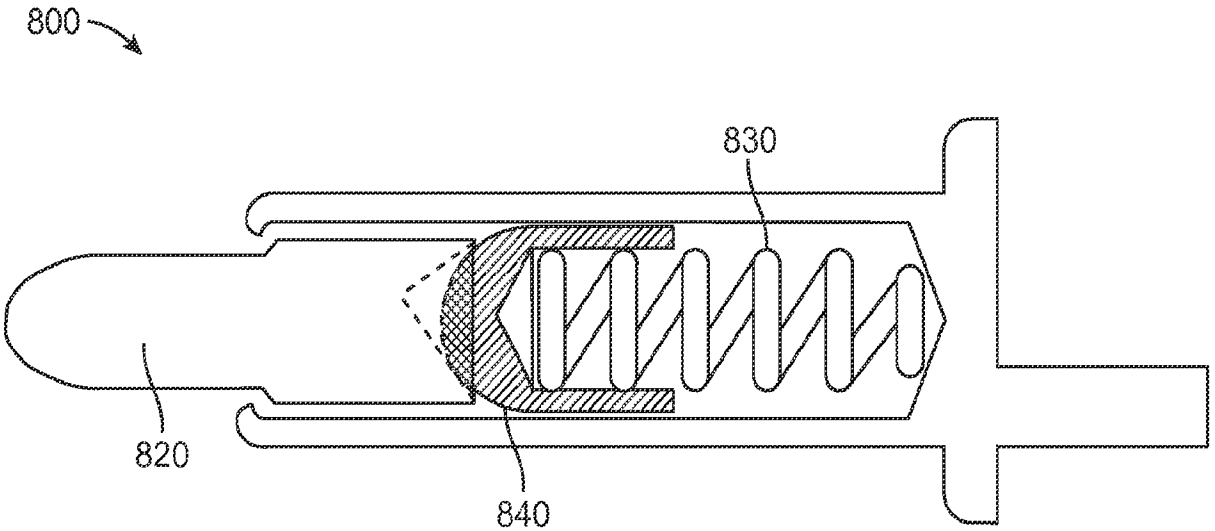
FIG. 8 illustrates another spring-loaded contact according to an embodiment of the present invention.

FIG. 8 illustrates another spring-loaded contact according to an embodiment of the present invention. In this example, a dome shaped cap 840 is used as an isolation object. Specifically, cap 840 is placed over spring 830. In this way, cap 840 isolates spring 830 from plunger 820.

In various embodiments of the present invention, the components of these and other spring-loaded contacts may vary. For example, the plunger and barrel may be brass or other copper based material, such as bronze. The plunger and barrel may further be plated, for example with gold. The spring may be formed of stainless steel, such as stainless steel 340. Spring 330 may be further coated with a dielectric material. In a specific embodiment of the present invention, the dielectric may be parylene. The piston may be made of various conductive materials, such as stainless steel, brass, gold-plated brass, or other material. The piston may be formed using nonconductive materials, such as ceramics, plastics, or other materials.

In these various examples, a front edge of an isolation object may be dome-shaped. In some examples, the dome shape may be somewhat spherical. In other embodiments of the present invention, the front edge of the isolation object may be flatter than a spherical shape. This may shorten the length of the isolation object, and therefore the length of the spring-loaded contact.

In various embodiments of the present invention, an additional object may be placed between a plunger and an isolation object. This additional object may be conductive and may provide an electrical path between the plunger and a barrel, though the additional object may instead be nonconductive. In still other embodiments the present invention, two additional objects may be employed. An example is shown in the following figure.

Figure 9:
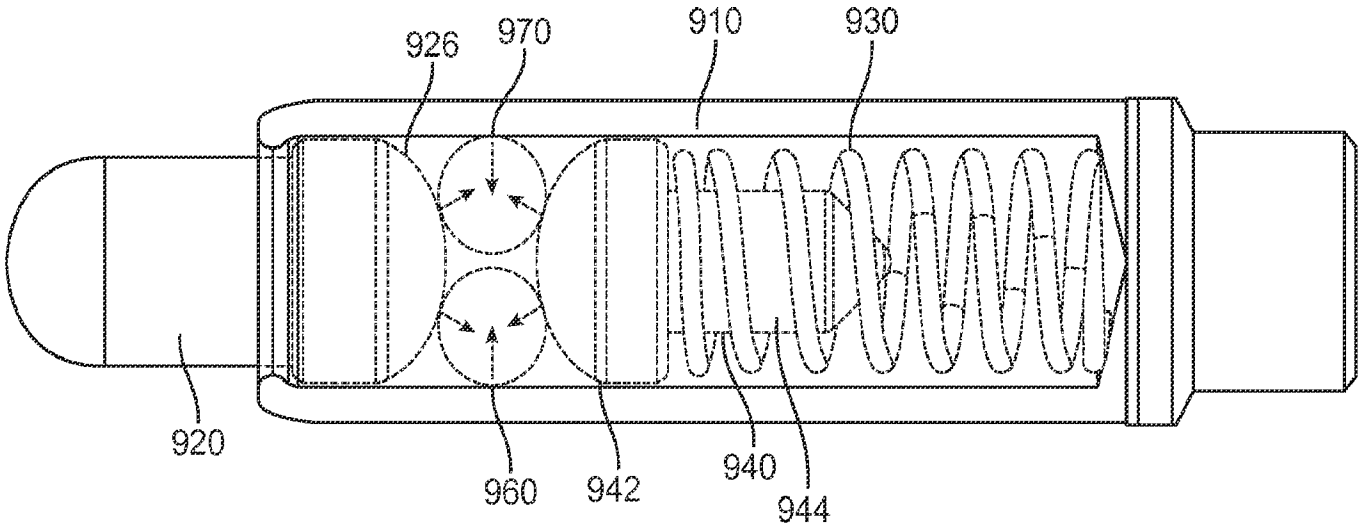
FIG. 9 illustrates another spring-loaded contact according to an embodiment of the present invention.

FIG. 9 illustrates another spring-loaded contact according to an embodiment of the present invention. This spring-loaded contact includes barrel 910, plunger 920, spring 930, and piston 940. Piston 940 may include a head portion 942 and a tail portion 944 that is substantially surrounded by spring 930.

In this example, two additional objects 960 and 970 are located between plunger 920 and piston 940. Additional objects 960 and 970 are shown as spheres, though in other embodiments of the present invention these may have other shapes. In a specific embodiment of the present invention, spheres or additional objects 960 and 970 may be conductive, though in other embodiments of the present invention, either or both additional objects 970 and 970 may be nonconductive.

Either or both of back surface of plunger 926 and front surface of piston head 942 may be convex as shown. This convex shape may push additional objects or spheres 960 and 970 against barrel 910 when plunger 920 is depressed. This may provide good contact between plunger 920 and barrel 910. Specifically, electrical paths between plunger 920 through spheres or additional objects 960 and 970 to barrel 910 may be formed. In this example, piston 940 may be insulative, though in other embodiments of the present invention, it may be conductive. If piston 940 is nonconductive, spring 930 may be isolated from large currents during operation.

In other embodiments of the present invention, pistons 940 may be replaced by isolation objects having other shapes. For example, such a replacement isolation object may be spherical or ball shaped. As in the above example, one or more additional objects may be placed between a plunger and isolation object. Also as in the above examples, a back of a plunger may have asymmetrical shapes. Examples are shown in the following figures.

Figure 10C:
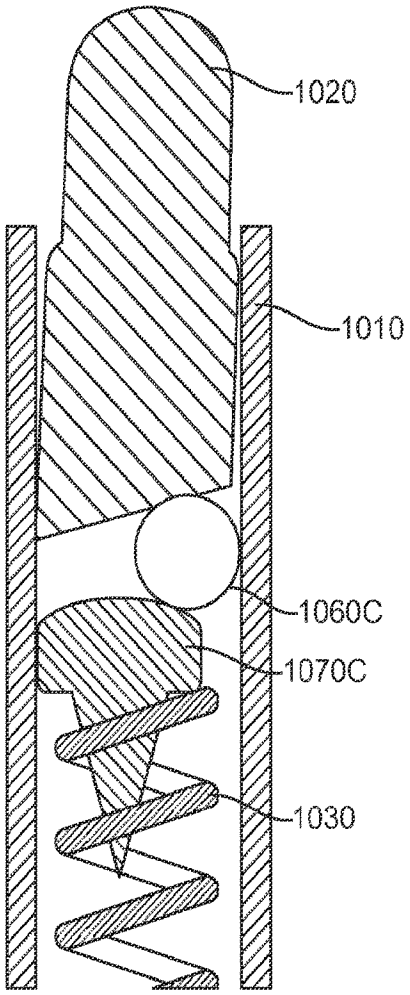
FIGS. 10A-10C illustrate spring-loaded contacts according to embodiments of the present invention.
Figure 10B:
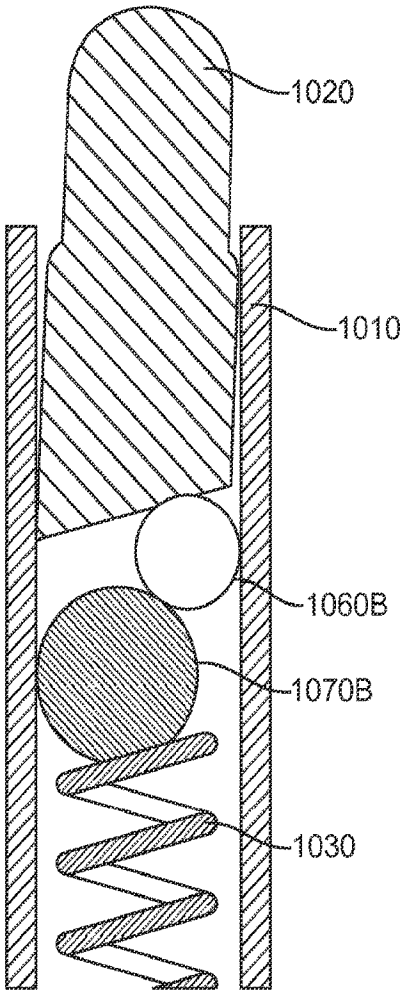
Figure 10A:
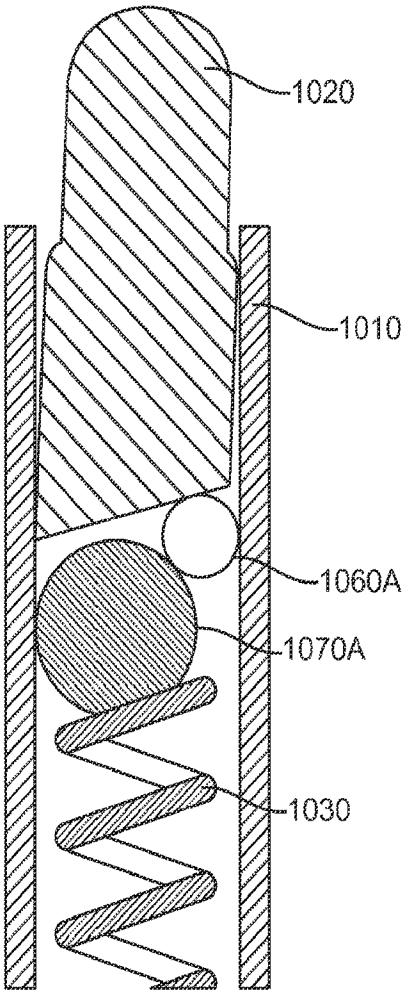

FIGS. 10A-10C illustrate spring-loaded contacts according to embodiments of the present invention. In FIGS. 1010A and 10B, a piston may be replaced with spring insulators 1070A and 1070B. Specifically, FIG. 10A illustrates a spring-loaded contact having a spherical isolation object (or spring insulator) 1070A and a spherical additional object 1060A. In this example, spring insulator or isolation object 1070A may be nonconductive, though in other embodiments of the present invention, spring insulator or isolation object 1070A may be conductive. In this example, the additional object may be conductive ball 1060A. Conductive ball 1060A may form a current path between plunger 1020 and barrel 1010.

In FIG. 10B, conductive ball 1060B is shown as being larger than conductive ball 1060A. The smaller conductive ball 1060A may reduce an overall length of a spring-loaded contact.

In FIG. 10C, plunger 1070C may be used in place of spring insulators 1070A and 1070B. Again, plunger 1070C may have a reduced height, thereby allowing a resulting spring-loaded contact to be shorter.

Figure 11:
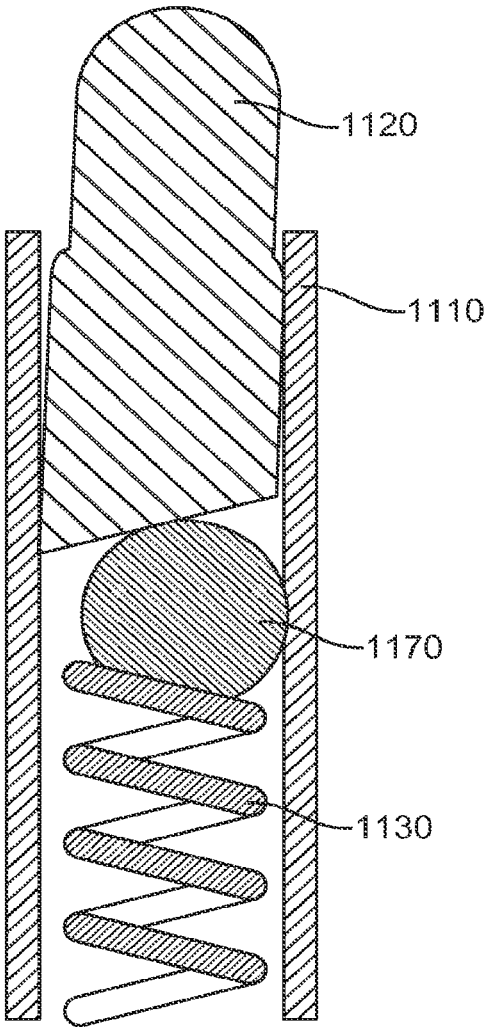
FIG. 11 illustrates a spring-loaded contact according to embodiments of the present invention.

FIG. 11 illustrates another spring-loaded contact according to an embodiment of the present invention. In FIG. 11, a piston may be replaced with spring insulator 1170. Specifically, FIG. 11 illustrates a spring-loaded contact having a spherical isolation object (or spring insulator) 1170. In this example, spring insulator or isolation object 1170 may be nonconductive, though in other embodiments of the present invention, spring insulator or isolation object 1170 may be conductive.

Again, various embodiments of the present invention may also employ structures, coatings, or other techniques, either alone or in combination, to improve the reliability of spring-loaded contacts. For example, contaminants, such as liquids, may be drawn inside a housing a spring-loaded contact. Contaminants may be drawn into the housing by vacuum and suction forces created when the plunger is depressed and released. Accordingly, an embodiment of the present invention may reduce these forces by adding a vent or other opening in the spring-loaded contact housing. By reducing the vacuum and suction forces created when the plunger is depressed and released, liquids and other contaminants are not drawn, or are drawn to a lesser extent, into the housing, and long-term reliability may be improved. Examples of this are shown in the following figures.

Figure 12A:
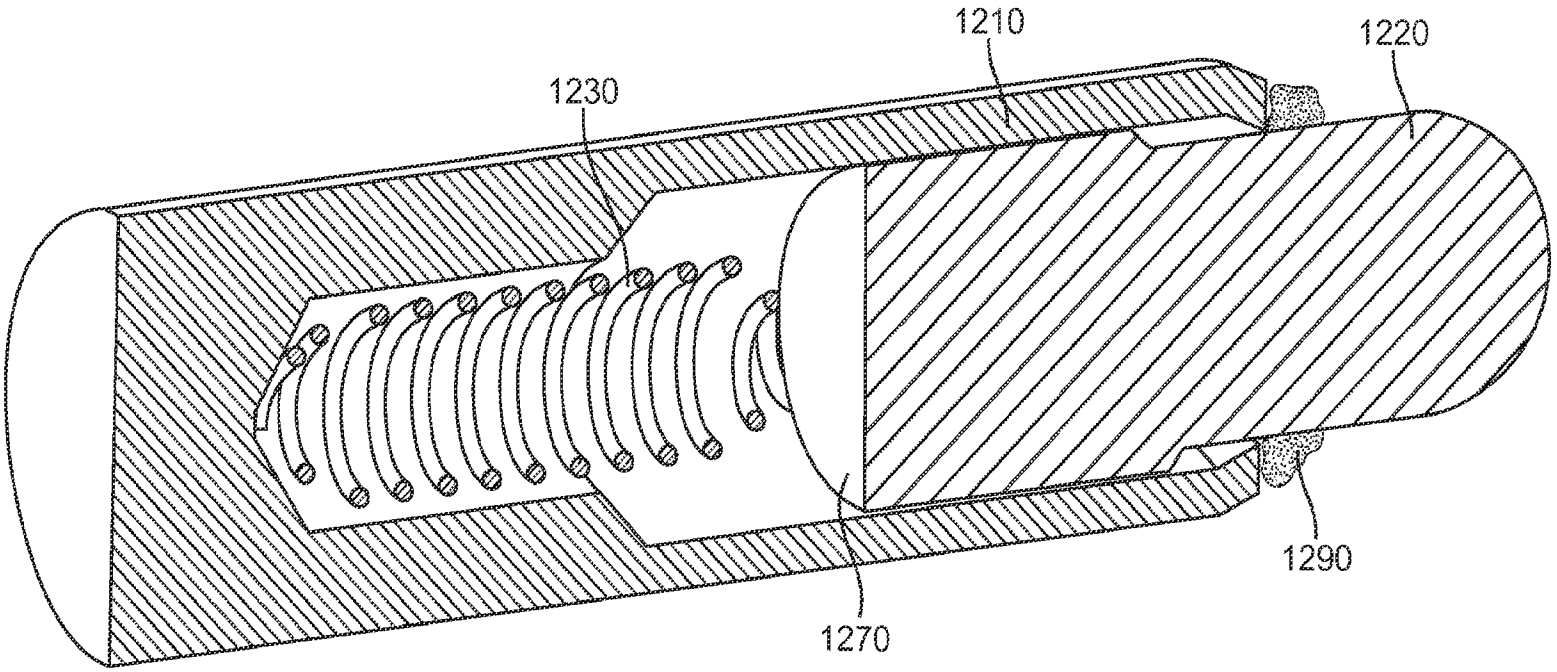
FIGS. 12A-12C illustrate contamination of a housing of a spring-loaded contact.
Figure 12B:
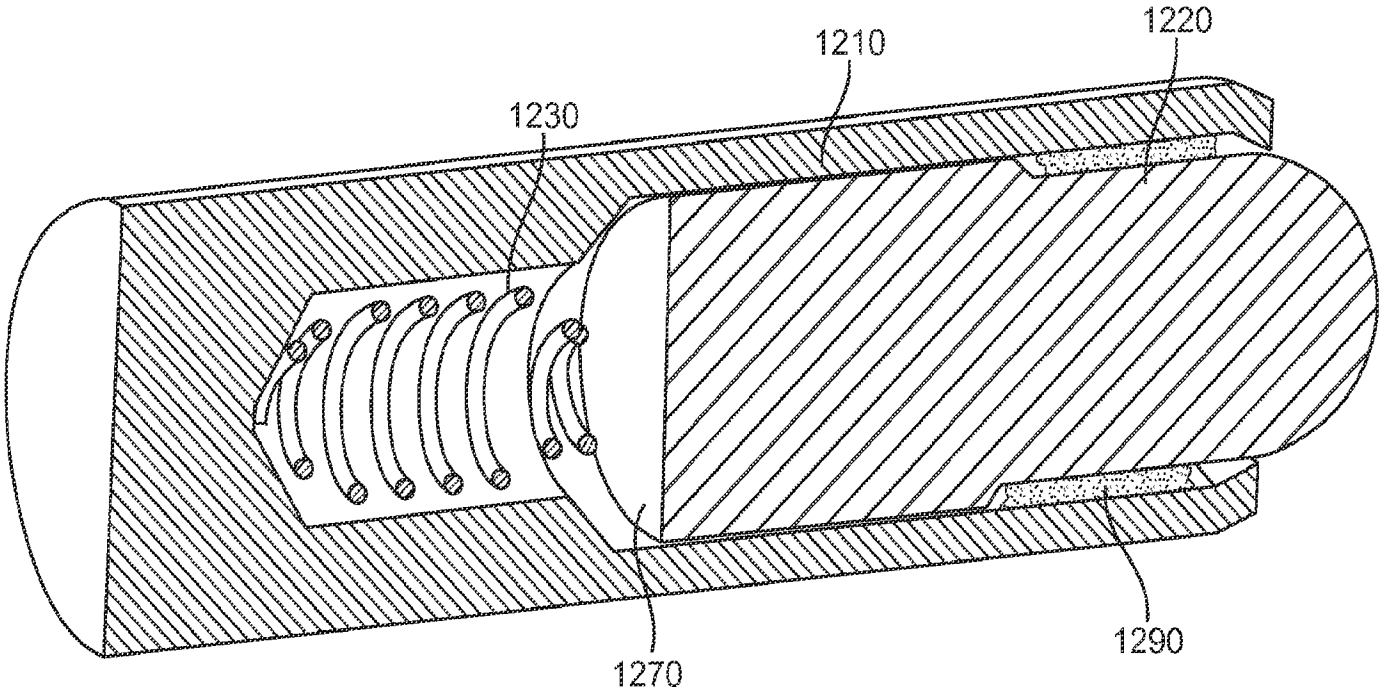
Figure 12C:
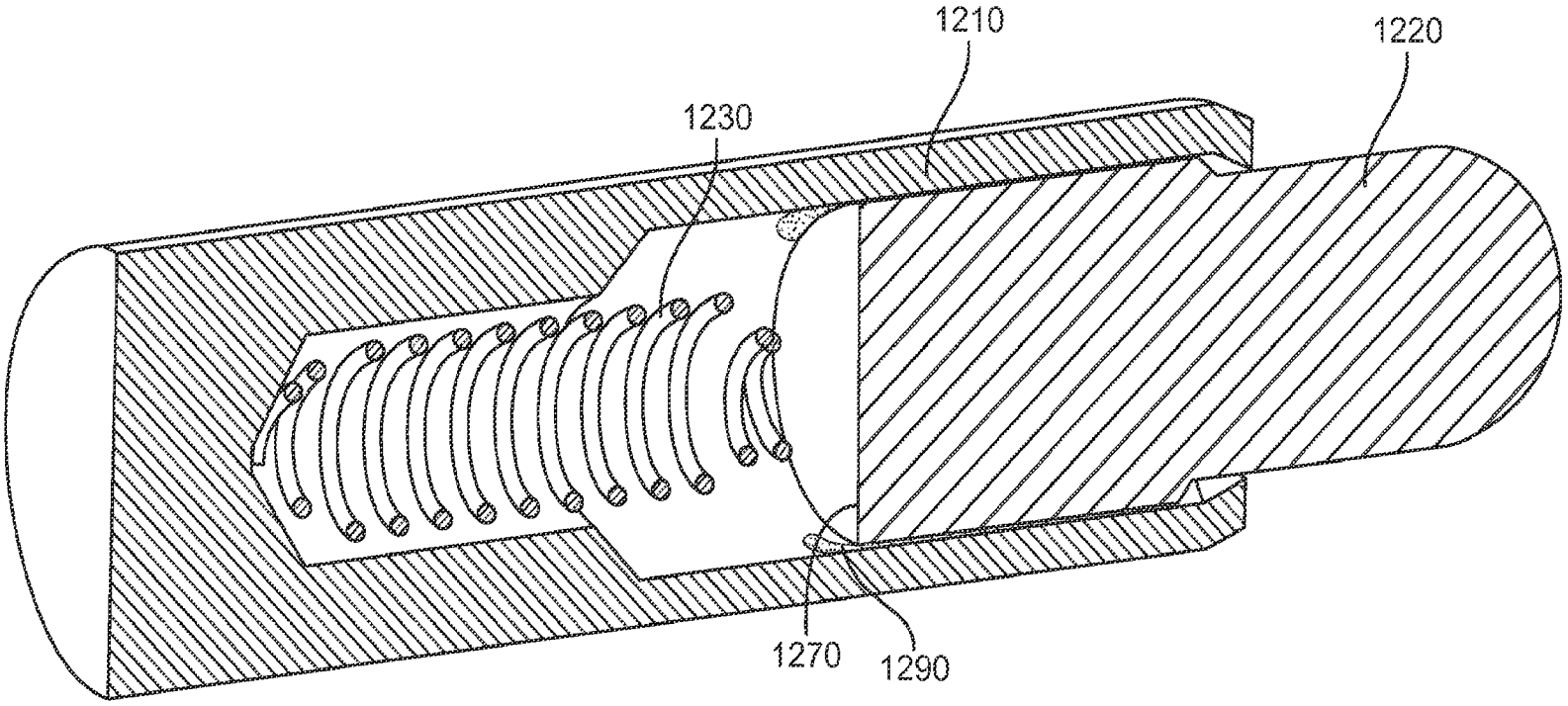

FIGS. 12A-12C illustrate the contamination of a spring-loaded contact. FIG. 12A illustrates a spring loaded contact having a plunger with a contaminant on its surface. This spring loaded contact includes housing 1210, plunger 1220, spring 1230, and spring-isolation object 1270. In this example, contaminant 1290 may reside on a portion of a surface of plunger 1220 near an opening of housing 1210. Contaminant 1290 may include liquid, dust, grit, or other liquid or particulate matter.

In FIG. 12B, plunger 1220 is depressed, thereby drawing contaminant 1290 into housing 1210. Specifically, contaminant 1290 may be drawn into the spring-loaded contact between housing 1210 and plunger 1220. While air is forced out of the spring-loaded contact when plunger 1220 is depressed, the relatively larger space between housing 1210 and plunger 1220 near the front of plunger 1220 may provide adequate space for contaminant 1290 to enter housing 1210.

In FIG. 12D, plunger 1220 is released. This action creates a vacuum or low-pressure effect inside the spring-loaded contact which draws contaminant 1290 further inside housing 1210. After plunger 1220 is depressed and released multiple times, more of contaminate 1290 may enter the spring-loaded contact chamber, specifically, the open portion of the spring-loaded contact where spring 1230 and isolation object 1270 reside. This contamination may foul or degrade spring 1230 or other associated components, which may lead to reduced functionality or failure.

Again, contaminate 1290 may be pulled inside the spring-loaded contact by the low pressure created inside the chamber as plunger 1220 is released. Accordingly, embodiments of the present invention may employ a vent or other opening to prevent this low pressure or vacuum from being created. Since the vacuum or low pressure is not created, contaminate 1290 is not drawn into the chamber of the spring-loaded contact, or at least it is drawn into the chamber to a lesser degree. An example is shown in the following figure.

Figure 13:
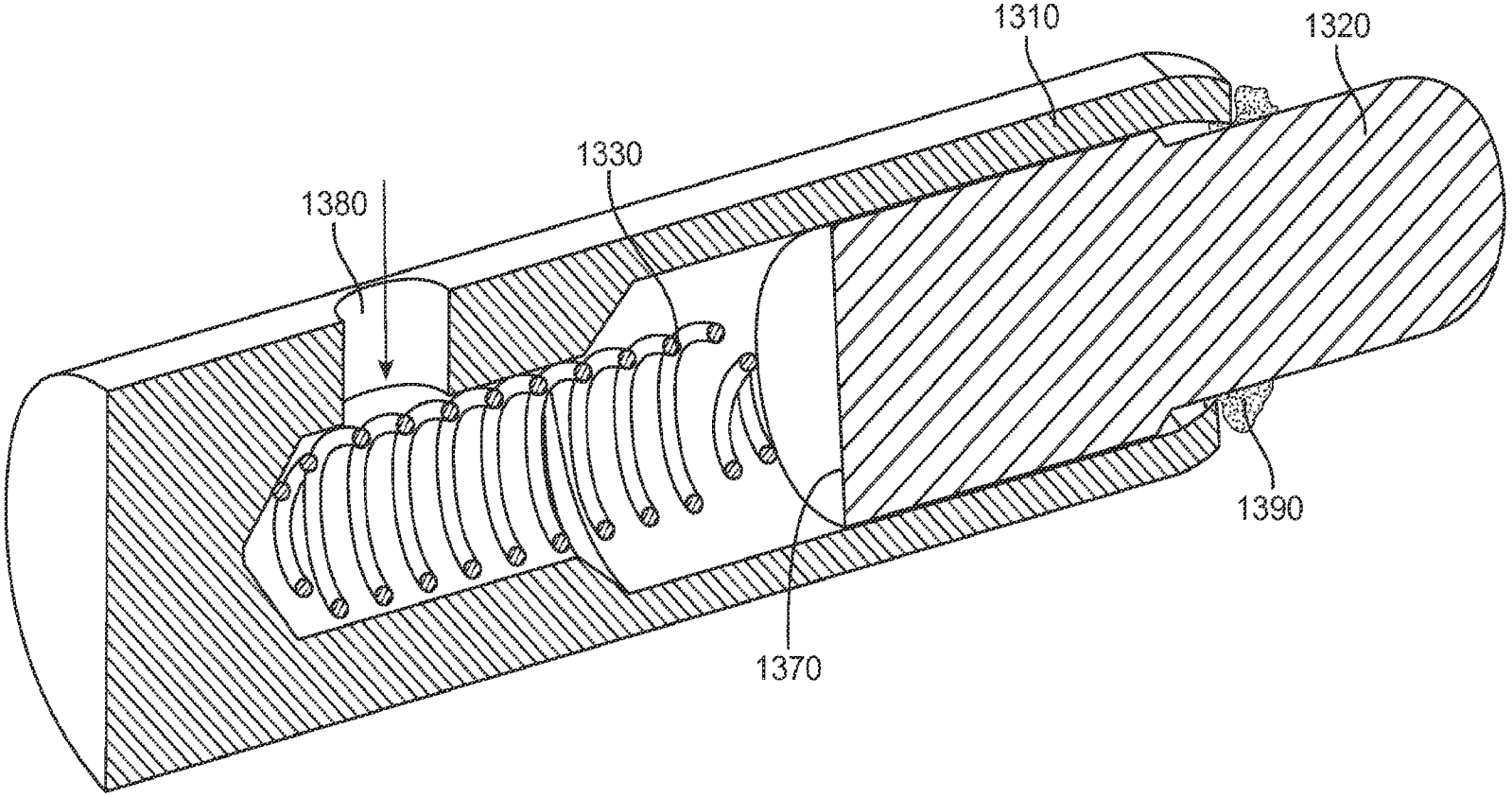
FIG. 13 illustrates a spring-loaded contact having a vented housing to reduce contamination.

FIG. 13 illustrates a spring-loaded contact having a vented housing to reduce contamination. The spring-loaded contact includes housing 1510, plunger 1320, spring 1530, isolation object 1370, and vent 1380. As before, contaminate 1390 is located on a surface of plunger 1320 near an opening of housing 1310. In this example, as plunger 1320 is released, vent 1380 may provide an opening for air to enter the chamber in housing 1510. Since a vacuum or low pressure is not created in the chamber, contaminate 1390 is not pulled into housing 1310. Instead, contaminate 1390 may be pushed out of housing 130 by plunger 1320. This may reduce or prevent the contamination of the chamber of the spring-loaded contact by contaminate 1390.

Again, in other embodiments of the present invention, portions of the spring-loaded contact may be coated. This coating may further protect the spring-loaded contact in the eventuality that some contamination occurs. Specifically, in various embodiments of the present invention, some or all of housing 1310, plunger 1320, spring 1330, isolation object 1370, additional object (not shown in this example), and other components, may be coated with one or more layers to provide protection against such contaminants, even when the risk of contamination may be reduced through the use of a vent or other opening. In various embodiments of the present invention, hydrophobic or oleophobic layers may be used to protect against contaminants. For example, parylene or other coatings may be used.

In various embodiments of the present invention, vent 1380 may be formed in various ways. For example, vent 1380 may be formed using drilling, laser etching, or other appropriate technique. In various embodiments of the present invention, the vent may be made of a comparable or larger size as compared to a gap between housing 1310 and plunger 1320. This may help prevent a low-enough chamber pressure from occurring that would draw in contaminants. In a specific embodiment of the present invention, a gap between housing 1310 and plunger 1320 may be 0.02 mm. Given the resulting area of this gap around plunger 1320, a vent 1380 may be made to be 0.4 mm in diameter.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A spring-loaded contact for an electrical connector, the spring-loaded contact comprising:

a barrel having a cylindrical wall, the wall terminating at one end in a front opening;

a plunger partially enclosed by the barrel and having a front portion extending through the front opening of the barrel, wherein a back surface of the plunger has an asymmetrical conical indentation formed in a tapered surface;

a spring enclosed by the barrel; and a piston having a symmetrical dome-shaped head located between the back surface of the plunger and the spring and a body substantially surrounded by the spring, wherein the head of the piston contacts the plunger at the back surface of the plunger.

2. The spring-loaded contact of claim 1 wherein an apex of the conical indentation is off-center.

3. The spring-loaded contact of claim 1 wherein the cylindrical wall of the barrel has a narrowing portion at the front opening, and the plunger has a notch at a front edge of a widened portion, where the notch acts as a stop preventing the plunger from exiting the barrel.

4. The spring-loaded contact of claim 1 wherein the piston is formed using stainless steel and the spring is formed using stainless steel and is coated with a dielectric.

5. The spring-loaded contact of claim 4 wherein the dielectric is parylene.

6. The spring-loaded contact of claim 1 wherein the spring is gold-plated.

7. The spring-loaded contact of claim 1 wherein the barrel includes a vent.

8. The spring loaded contact of claim 1 wherein the plunger has a first length along a first side and a second length along a second side, the second side opposite the first side, the second length longer than the first length.

9. The spring-loaded contact of claim 8 wherein an apex of the conical indentation is off-center towards the first side of the plunger.

10. A spring-loaded contact for an electrical connector comprising:

a barrel having a cylindrical wall, the wall terminating at one end in a front opening;

a plunger at least partially enclosed by the barrel and having a front portion extending through the front opening of the barrel;

a spring enclosed by the barrel; and a piston having a symmetrical dome-shaped head located between the plunger and the spring and a body substantially surrounded by the spring, wherein a back surface of the plunger has an asymmetrical conical indentation formed in a tapered surface, and the plunger has a first length along a first side and a second length along a second side, the second length longer than the first length.

11. The spring-loaded contact of claim 10 wherein an apex of the conical indentation is off-center towards the first side of the plunger.

12. The spring-loaded contact of claim 10 wherein the cylindrical wall of the barrel has a narrowing portion at the front opening, and the plunger has a notch at a front edge of a widened portion, where the notch acts as a stop to keep the widened portion of the plunger in the barrel.

13. The spring-loaded contact of claim 10 wherein the piston is formed using stainless steel and the spring is formed using stainless steel and is coated with a dielectric.

14. The spring-loaded contact of claim 13 wherein the dielectric is parylene.

15. The spring-loaded contact of claim 10 wherein the barrel includes a vent.

16. A spring-loaded contact for an electrical connector comprising:

a barrel having a cylindrical wall, the wall terminating at one end in a front opening;

a plunger at least partially enclosed by the barrel and having a front portion extending through the front opening of the barrel, wherein an entire back surface of the plunger has an off-center conical indentation formed in a tapered surface;

a spring enclosed by the barrel; and a piston having a symmetrical dome-shaped head located between the back surface of the plunger and the spring and a body substantially surrounded by the spring, wherein the head of the piston contacts the plunger at the back surface of the plunger.

17. The spring-loaded contact of claim 16 wherein the barrel includes a vent.

18. The spring-loaded contact of claim 16 wherein the cylindrical wall of the barrel has a narrowing portion at the front opening, and the plunger has a notch at a front edge of a widened portion, where the notch acts as a stop to keep the widened portion of the plunger in the barrel.

19. The spring loaded contact of claim 18 wherein the plunger has a first length along a first side and a second length along a second side, the second side opposite the first side, the second length longer than the first length, and wherein an apex of the conical indentation is off-center towards the first side of the plunger.

* * * * *